US006648724B1

(12) United States Patent
Tammera

(10) Patent No.: US 6,648,724 B1
(45) Date of Patent: Nov. 18, 2003

(54) TOY RAILWAY LIQUID TRANSFER FACILITY

(76) Inventor: Robert F. Tammera, 7081 Auburn Mill Rd., Warrenton, VA (US) 20187

( * ) Notice: Subject to any disclaimer, the term of this patent is extended or adjusted under 35 U.S.C. 154(b) by 71 days.

(21) Appl. No.: 09/950,371

(22) Filed: Sep. 13, 2001

(51) Int. Cl.[7] ..... A63H 3/52; A63H 17/12

(52) U.S. Cl. ..... 446/476; 446/425

(58) Field of Search ..... 446/424, 425, 446/426, 427, 428, 423, 467, 476; 104/DIG. 1

(56) References Cited

U.S. PATENT DOCUMENTS 1,951,263 A * 3/1934 Anzlovar ..... 446/424
2,017,616 A * 10/1935 Cuff ..... 446/424
2,226,875 A * 12/1940 Rexford ..... 446/428
2,316,680 A * 4/1943 Ferri ..... 212/285
2,438,603 A * 3/1948 Erhardt ..... 446/424
2,940,607 A * 6/1960 Bonanno ..... 212/285
4,312,149 A * 1/1982 Iwao ..... 446/269
4,961,716 A * 10/1990 Hippely et al. ..... 446/75
5,131,881 A * 7/1992 Okada ..... 446/424
6,099,380 A * 8/2000 Rasmussen ..... 446/478

* cited by examiner

*Primary Examiner*—Jacob K. Ackun
*Assistant Examiner*—Faye Francis
(74) *Attorney, Agent, or Firm*—Edward Goldberg

(57) ABSTRACT

A toy train tanker car is positioned on tracks alongside a liquid transfer storage facility. A motor driven loading platform is mounted on a supporting frame. The motor is coupled through gearing and a crank arm follower to move the pivotable loading platform up and down over the tanker car. A figure of an attendant carrying a hose nozzle is positioned at the end of the platform to simulate the transfer of fuel to the tanker car.

5 Claims, 4 Drawing Sheets

26
36
38
22
40
42
48
44
50
46
56
54
24
18
12
30
28
16
14
52
20

TOY RAILWAY LIQUID TRANSFER FACILITY

BACKGROUND OF THE INVENTION

1. Field of the Invention

The present invention relates to a mechanism for simulating the transfer of liquids from a toy storage facility to a toy train tanker car and particularly to a motor driven loading platform supporting an attendant carrying a hose nozzle which is lowered over the tanker car fuel receptacle and then lifted upon completion of the simulated liquid transfer operation.

2. Description of the Prior Art

Previous devices for simulating loading of toy railroad cars utilizing trackside loading platforms are directed to specific mechanical functions such as transferring movable toy figures or stock animals from a platform into a stock car, as shown in U.S. Pat. No. 2,882,644 to Bonanno et al.

U.S. Pat. No. 1,942,167 to Handy concerns a device having a platform element representing a railroad crossing gate raised and lowered into position and a toy signalman moving a signal upon passage of a train.

U.S. Pat. No. 1,966,031 to Handy shows a toy figure incorporating a mechanism which causes an arm of the figure to wave as it passes out of a doorway incident to the arrival of a train.

U.S. Pat. No. 4,458,440 to D'Andrade et al concerns a toy barn and silo having an elevator which receives and lifts toy bales of hay to a loft and then ejects them for discharge into a vehicle in a bay of the barn.

U.S. Pat. No. 5,816,887 to Rudell et al shows a radio controlled toy train and remote control trigger to activate a mechanism for loading toy barrels from a ramp into a container compartment of a train. When the train moves to an unloading station, the remote trigger control activates a cam to tilt the container compartment and cause the barrels to roll off into a bin at the side of the train.

While these prior art devices show various mechanisms for simulating loading of toy railroad cars related to particular types of loads and operations, none of these concern the transfer of a liquid or fuel from a storage facility platform by an attendant directing a hose nozzle into a tanker car receptacle.

SUMMARY OF THE INVENTION

It is therefore the primary object of the present invention to provide a novel mechanism for simulating the loading of a liquid into a toy train tanker car from a platform of a liquid storage facility.

It is another object of the invention to provide a unique mechanism for lowering a platform supporting a figure holding a hose nozzle over a fuel receptacle of a toy tanker car.

It is a further object of the invention to provide a motor driven platform for lowering and raising a figure carrying a hose nozzle positioned above a toy tanker car on tracks alongside the liquid storage facility.

These objects are achieved with a unique structure including a supporting frame having a miniature drive motor and gearing mounted on the frame and coupled to a pivotable platform. A figure of an attendant carrying a hose nozzle is positioned at the end of the platform which is lowered over a fuel receptacle on the top of a toy tanker car on tracks alongside the frame. The platform and figure are raised to an up position upon completion of the simulated loading operation to await the next cycle. Other objects and advantages will become apparent from the following description in conjunction with the accompanying drawings.

DESCRIPTION OF THE PREFERRED EMBODIMENTS

Figure 1:
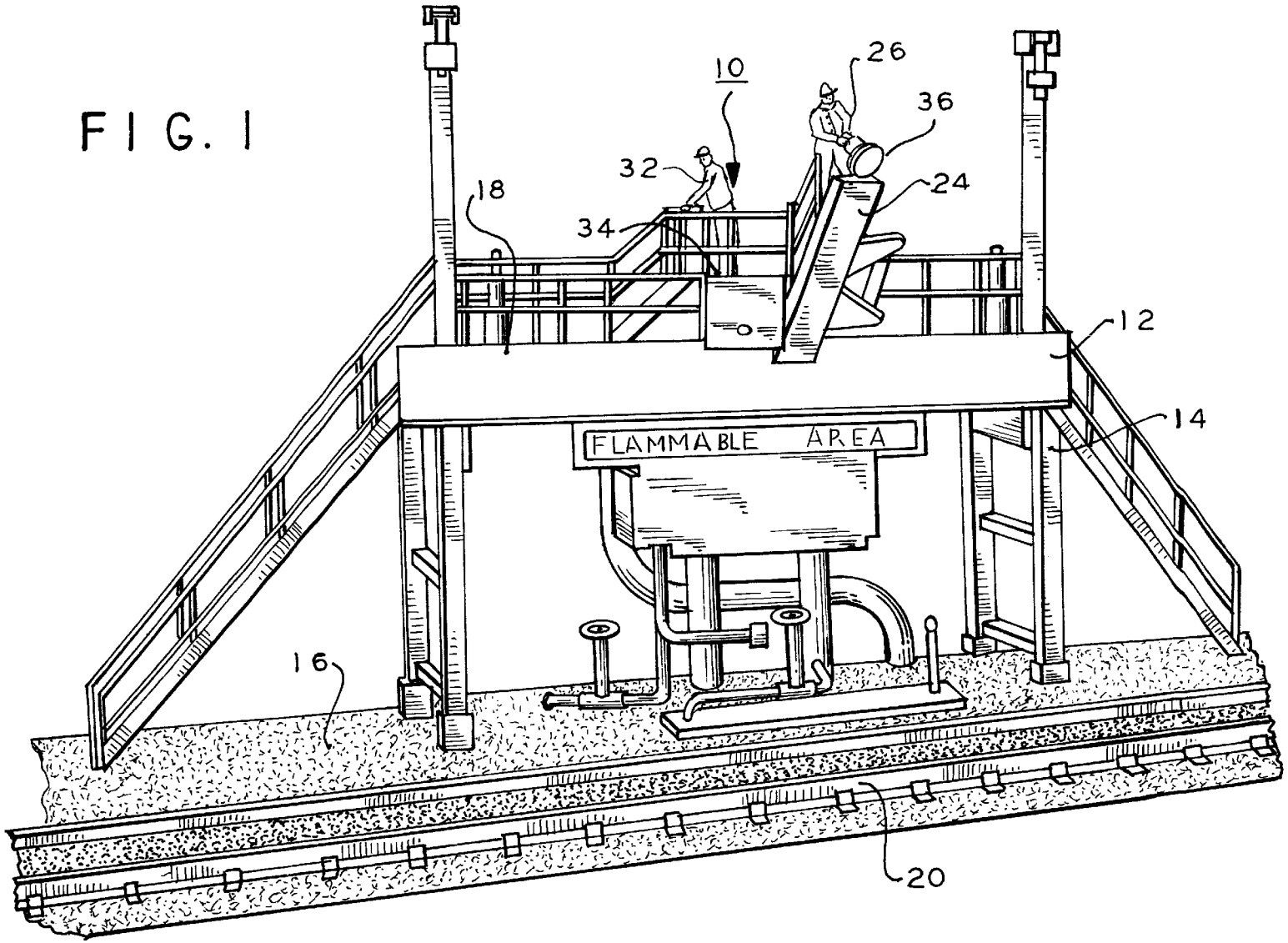
FIG. 1 is a front perspective view of the toy liquid transfer facility including supporting frame, movable loading platform and attendant adjacent the railroad tracks.
Figure 2:
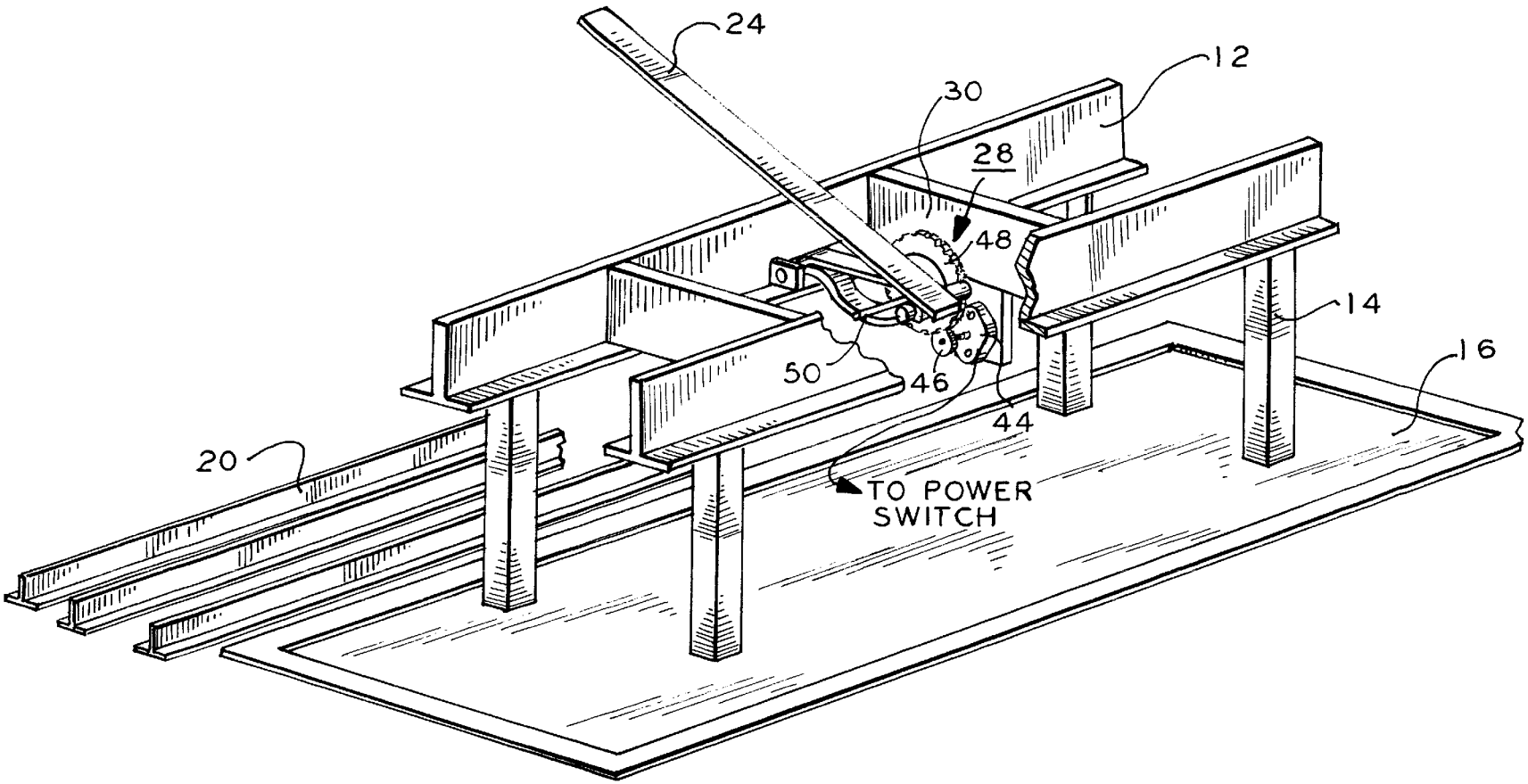
FIG. 2 is a perspective back view showing cutaway portions of the supporting frame and drive mechanism for the loading platform.

As shown in FIG. 1, the toy liquid transfer facility or station 10, includes a supporting frame 12 having front and rear vertical posts 14 extending from a base 16 to an upper horizontally extending member 18. The facility structure is positioned alongside railroad tracks 20 on which a wheeled toy train tanker car 22, shown in FIGS. 3 and 4, rides. A pivotable loading platform 24 carrying a figure of an attendant 26 on the front outer end is coupled to a driving mechanism 28 mounted on a side of a cross member 30 of the frame, shown in FIG. 2. A second worker 32 is positioned on a raised deck 34. The attendant 26 is holding a fuel hose nozzle 36 ready to engage a receptacle 38 on the roof of the tanker car.

Figures 3, 4, 7:
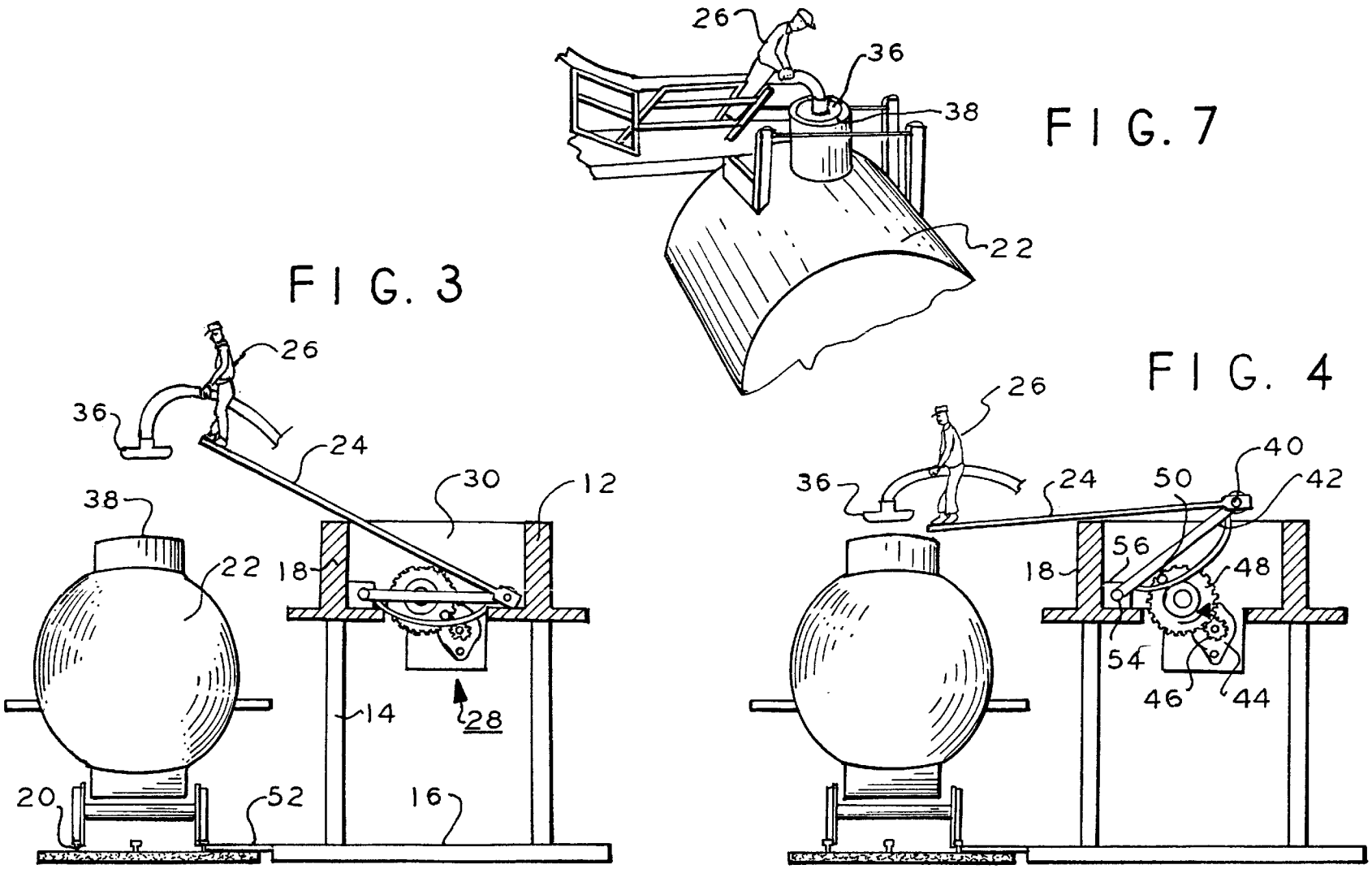
FIG. 3 is a side view of portions of the frame, drive mechanism, attendant and loading platform in a normal raised position over a tanker train car on adjacent tracks.
FIG. 4 is a partial side view showing the drive mechanism on the frame with the loading platform and attendant in a lowered position.
FIG. 7 is a perspective side view of a portion of the lowered loading platform and attendant holding a hose nozzle over the tanker car.
Figure 5:
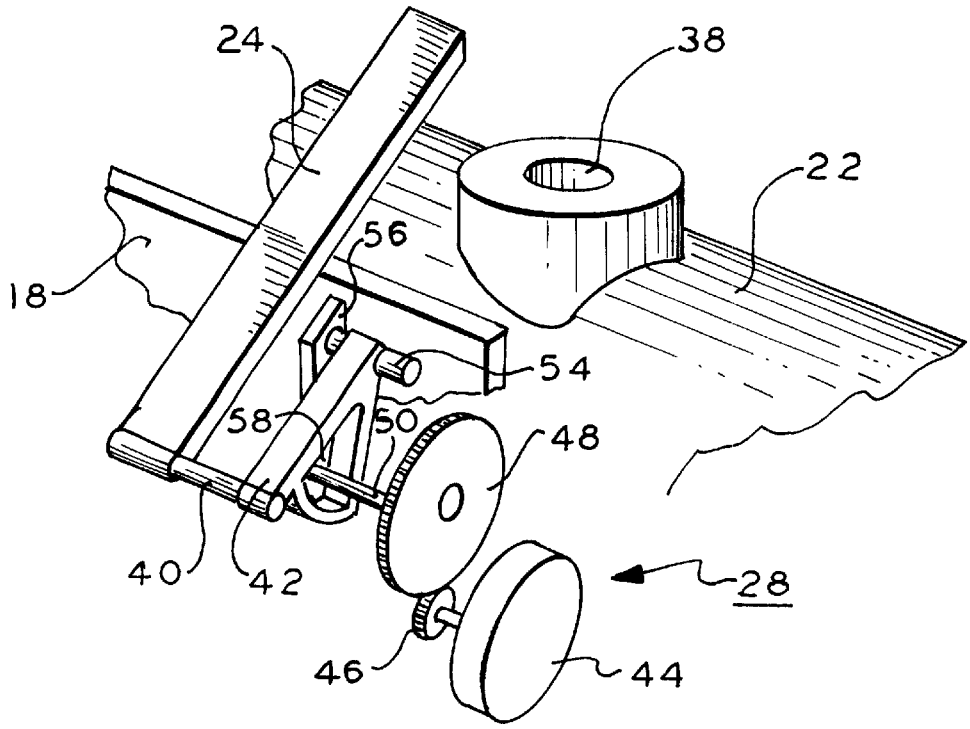
FIG. 5 is a perspective schematic view of the drive mechanism and loading platform in a raised position over the tanker car opposite to the side view of FIG. 3.
Figure 6:
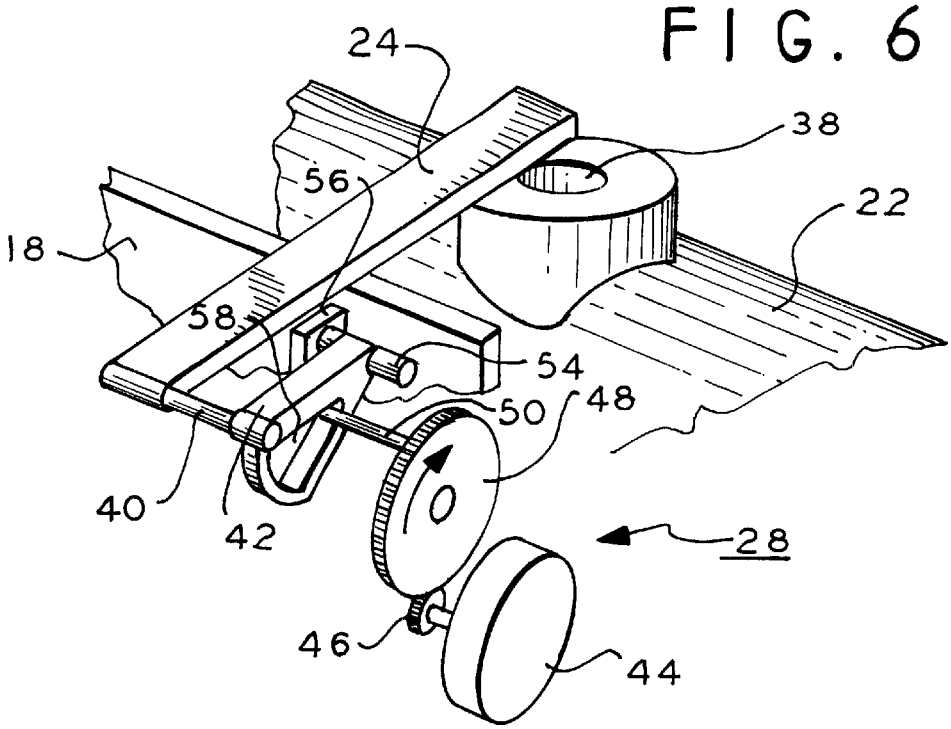
FIG. 6 is a perspective schematic side view opposite to that of FIG. 4 of the drive mechanism and platform in a lowered position.

As shown in FIGS. 4, 5 and 6, the back inner end of loading platform 24 is pivotally linked to a movable axle 40 coupled to a freely movable crank arm follower 42. The driving mechanism 28 includes a unidirectional direct current motor 44 having a 40:1 ratio gear reduction to a small pinion gear 46 driving a larger gear 48 having a crank arm 50 mounted thereon, as shown more clearly in FIGS. 5 and 6.

When the tanker car 22 stops on the tracks alongside the liquid transfer facility, a gauge or grating 52 establishes the proper position of the hose nozzle over the car on the tracks. An electrical control switch, not shown, is then actuated to operate motor 44, causing pinion gear 46 to rotate gear 48 and crank arm 50. Crank arm 50 rides along movable crank arm follower 42 which pivots about a pivot axle 54 secured within a pivot support 56 affixed to bulkhead 18. As shown from opposite sides in FIGS. 4 and 6, when crank arm 50 is rotated 180 degrees by gear 48, it moves up from the lower position on gear 48 of FIGS. 3 and 5 and raises crank arm follower 42 as it pivots about the fixed position of pivot axle 54. Since arm follower 42 is coupled to movable axle 40 pivotally linked to the inner end of loading platform 24, that end of platform 24 is raised, while the outer end of platform 24 rotates to a down or lowered position over the fuel receptacle 38 of tank car 22.

As shown in FIG. 7, the attendant standing at the front end of the platform carrying fuel hose nozzle 36, now appears to be bending over to place the nozzle over the fuel receptacle 38 to simulate the transfer of fuel to the tanker car. The open area 58 under crank arm follower 42 permits some leeway for additional movement of the crank arm by the motor to self adjust for different sized tanker cars and track heights without binding in the follower. Rotation of the crank arm causes the front end of the platform to rest on the first object contacted. If the tank car is not contacted, the platform will rest on the frame structure.

As the motor continues to turn, crank arm 50 rotates through the next 180 degrees causing the crank arm follower and back end of the pivotal platform to move downwardly and rotate in the opposite direction to return the front end to the normal up position of the loading platform. The fueled tanker car can then move out from the facility until the next operating sequence is initiated.

While only a single embodiment has been illustrated and described, other variations may be made in the particular configuration without departing from the scope of the invention as set forth in the appended claims.

What is claimed is:

1. A toy station for simulating the transfer of liquids to a transfer car comprising:

a base, a supporting frame mounted on said base, including front and rear vertical posts extending upwardly from said base, horizontally extending members and cross members secured to upper portions of said vertical posts, a tanker car loading area disposed alongside said base adjacent said supporting frame, a pivotable loading platform positioned on said supporting frame and extending over said loading area, a tanker car positioned in said loading area alongside said base and frame, a figure of an attendant carrying a hose nozzle positioned on an outer end of said loading platform, and drive means mounted on said frame for moving said loading platform from a raised position to a lowered position extending over said loading area, said drive means being coupled to a back end of said platform to move said outer end and figure into said lowered position over said tanker car to simulate the transfer of liquids to said tanker car and to return said outer end and figure to a raised resting position.

2. The device of claim 1 wherein said drive means includes a small motor secured on one of said frame cross members, said motor including a drive shaft, gear means coupled to said drive shaft, a crank arm secured to said gear means, a crank arm follower coupled to said crank arm and having a front end pivotally secured to said frame, the back end of said crank arm follower being coupled to the back end of said platform, actuation and rotation of said motor and said gear means causing initial rotation of said crank arm and pivotal movement of said crank arm follower to move said back end of said platform upwardly from a lower resting position and said outer end of said platform downward over said tanker car, continued rotation of said motor and crank arm and pivotal movement of said crank arm follower causing lowering of said back end of said platform and raising said outer end to return to a resting position.

3. The device of claim 2 wherein said loading area includes railroad tracks alongside said base and said tanker car is a wheeled train car moveable along said tracks, said tanker car having a liquid fuel receptacle on an upper surface, said figure of an attendant carrying said hose nozzle on said loading platform being moved over said fuel receptacle in said lowered position.

4. The device of claim 3 including an open area under said crank arm follower, said crank arm engaging said crank arm follower in said open area, said open area permitting additional movement of said crank arm by said motor to accommodate the loading platform to different sized tanker cars and track heights.

5. The device of claim 4 including grating means disposed between the base of the station and the tracks alongside to establish the position of the tanker car and fuel receptacle with respect to the hose nozzle carried by the figure at the end of the loading platform.

* * * * *